United States Patent [19]

Numata et al.

[11] 3,994,399

[45] Nov. 30, 1976

[54] PACKAGING MEANS SUITABLE FOR ELECTRICAL OR SIMILAR PARTS

[75] Inventors: Hidekazu Numata, Katano; Kazumi Idou, Yao, both of Japan

[73] Assignee: Matsushita Electric Industrial Co., Ltd., Osaka, Japan

[22] Filed: Oct. 29, 1974

[21] Appl. No.: 518,934

[30] Foreign Application Priority Data

| | | |
|---|---|---|
| Nov. 1, 1973 | Japan | 48-120896 |
| Oct. 11, 1974 | Japan | 49-123338[U] |
| Oct. 11, 1974 | Japan | 49-123339[U] |
| Oct. 11, 1974 | Japan | 49-123340[U] |

[52] U.S. Cl. ..... 206/521; 229/14 C; 229/34 HW

[51] Int. Cl.[2] ..... B65D 81/02; B65D 43/16

[58] Field of Search ..... 229/34 HW, 14 C, 40; 206/521, 523

[56] References Cited

UNITED STATES PATENTS

| | | | |
|---|---|---|---|
| 1,585,682 | 5/1926 | Oppenheim | 229/14 |
| 1,696,341 | 12/1928 | Blanchard | 229/14 C |
| 1,925,298 | 9/1933 | Boeye | 151/38 |
| 2,308,818 | 1/1943 | Leukoff | 229/34 HW |
| 2,448,679 | 9/1948 | Meinhardt | 229/34 HW |
| 3,048,668 | 8/1962 | Weiss | 206/521 |

FOREIGN PATENTS OR APPLICATIONS

| | | | |
|---|---|---|---|
| 1,211,742 | 11/1970 | United Kingdom | 206/523 |

*Primary Examiner*—William T. Dixson, Jr.
*Assistant Examiner*—Douglas B. Farrow
*Attorney, Agent, or Firm*—Wenderoth, Lind & Ponack

[57] ABSTRACT

A packaging means made of uniform material such as paperboard which is formed as an open-topped box-like structure constituted by hollow columns surrounding a main base portion and containing paper pipes which fit without play therein and render the box structure rigid and shock-proof. The main base portion may be provided as a double base, and may be backed by auxiliary boards to further strengthen the base portion and serve as supports to the box structure if required. An article to be packaged is held between or contained in one or more pairs of packaging means, which may be strapped together to constitute a single packaging unit, or may be inserted directly into a larger outside container for accommodation of one or a plurality of packaged articles.

3 Claims, 13 Drawing Figures

PACKAGING MEANS SUITABLE FOR ELECTRICAL OR SIMILAR PARTS

The present invention relates to a packaging means, and more particularly to an improved packaging means made of uniform material such as paperboard and presenting the advantages of ease of assembly and of disposal.

There is known a great variety of packaging means employing paperboard as the principal material. For certain types of commodities a requirement is that the packaging means simply contain and retain the commodity, and means such as slotted cardboard boxes are satisfactory. However, for other types of commodities, such as electrical equipment, for example, paperboard is sufficiently strong to contain an article, but a further requirement is that the packaging means must be able to protect the packaged articles from shock or impact that may be occasioned during transport thereof. It is known conventionally to provide such protection by padding a packaged article with foam or blister synthetic resin material, or with layers of corrugated cardboard, or by providing positioning insets in the packaging means. Use of synthetic resin material has the disadvantages in that packaging costs are raised; it is subsequently difficult to dispose of; and it must be separated from the paperboard constituting the main packaging means. Use of layers of corrugated cardboard or of positioned inserts made of cardboard, while economical from the point of view of material, tends to lead to increased labour costs since the sheets of corrugated cardboard, often in a variety of sizes, must be separately packed, or the positioned inserts must, of course, themselves be accurately positioned.

It is accordingly a principal object of the present invention to provide an improved packaging means which may be easily handled as a single unit and which provides shock-proof protection to articles packaged therein.

It is a further object of the invention to provide a shock-proof packaging means which is made of uniform, lowprice material such as paperboard and is easily disposable or re-usable, as required.

In accomplishing these and other objects there is provided, according to the present invention, a packaging means constituted by a single sheet of paperboard, or similar material, comprising a base portion and integral side extensions foldable to form sealed hollow columns which surround the base portion, thereby constituting an open-topped box, and in which seal columns there are provided paperboard tubes which fit without play therein and provide rigidity and impart shock absorption properties to the box structure. The base portion of the box may be backed by auxiliary boards which serve to strengthen the base portion and protect a packaged article from impact, and according to one embodiment of the invention, a supplementary stiffener board may be fitted over the base portion inside the box. An article to be packaged is contained between two boxes thus constructed, the boxes providing complete or only partial enclosure, depending on the nature of the article and the packing requirements. One or a plurality of article thus protected may be held in a larger container. An exact fit is ensured since the size of the article and of the packaging means are always known. If required, an enclosed article may be treated as a separate unit with the boxes held in place by straps, cords, or other suitable means. The packaging means of the present invention presents the advantages that packaged articles may be easily handled as units of constant dimensions, that the articles are protected from impact without separately provided padding material being necessary, and that the packaging means is easily disposable after use.

A better understanding of the present invention may be had from the following full description of the several embodiments thereof when read in reference to the attached drawings in which like numbers refer to like parts.

FIG. 3(*b*) shows a plane view showing the material of auxiliary boards of FIG. 1 prior to assembly thereof;

FIG. 7(*b*) is a plane view of a supplementary base portion employed in the means of FIG. 5;

FIG. 7(*c*) shows a plane view showing the material of auxiliary boards of FIG. 5 prior to assembly thereof;

Figure 1:
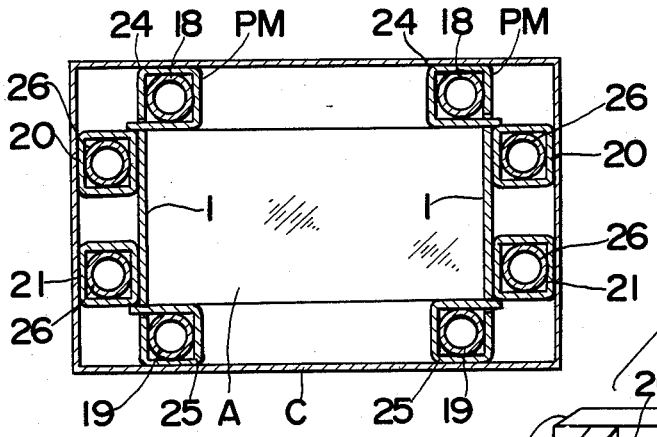
FIG. 1 is a horizontal cross-sectional view illustrating the general manner of packaging an article with a means according to a 1st embodiment of the invention.

Referring initially to FIG. 1 there is shown an article A which is held between two packaging means PM, PM in an outside container C. All elements of the packaging means PM are made of paperboard or similar material and each packaging means PM comprises side columns 24 and 25, which are hollow, have an approximately square or near-square cross-section, contain re-inforcement pipes 18 and 19, respectively, and are formed on opposite sides of a base portion 1, the inner sides of the columns 24 and 25 and the base portion 1 together defining a space for exact accommodation of one side of the article A. To the outer side of the base portion 1, there are fixedly attached symmetrically -disposed auxiliary boards 20 and 21 which each have a square or near-square cross-section, and extend the length of the base portion 1 and parallel to the columns 24 and 25. The auxiliary boards 20 and 21 are made of paperboard or similar material and are suitably attached to the outer side of the base portion 1 with adhesive. The outer walls 24*a* and 25*a* of the columns 24 and 25 and 20*a* and 21*a* of the auxiliary boards 20 and 21 contact the inner side of the container C, whereby the article A held between the packaging means PM is protected from the effects of direct impact.

Figure 2:
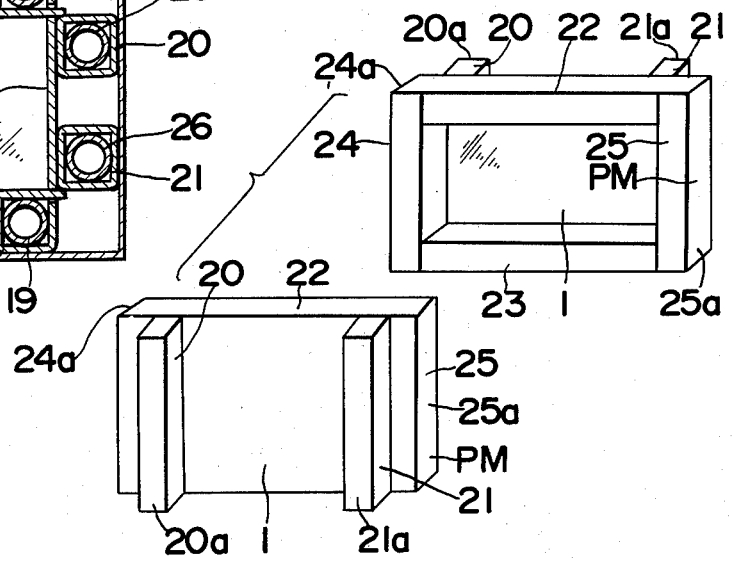
FIG. 2 is a perspective front view of the packaging means of FIG. 1.

Referring to FIG. 2, the base portion 1 of each packaging means PM may be seen to be generally rectangular, and to be bordered along the two short sides by the abovementioned columns 24 and 25, and along the two long sides by columns 22 and 23, there thus being formed an open-topped box structure having base portion 1 as the base. Similar to the columns 24 and 25, the columns 22 and 23 are hollow, each has a generally square or near-square cross-section and contains a re-inforcement pipe 16 and 17 respectively. The column 22 is defined by walls 2*a*, 3*a*, and 4*a*, the column 23 by walls 2*b*, 3*b* and 4*b*, the column 24 by walls 7*a*, 8*a* and 9*a*, and the column 25 by walls 7*b*, 8*b* and 9*b*, as shown in FIG. 3(*a*).

Figure 3:
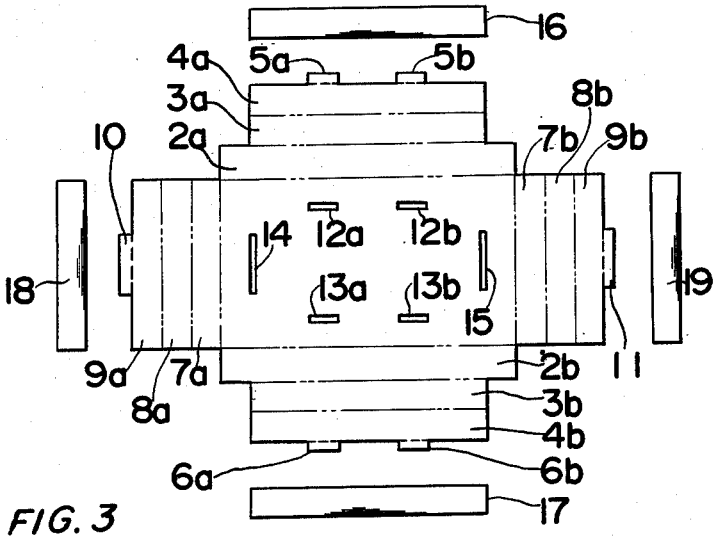
FIG. 3(*a*) is a plane view showing the material of FIG. 1 prior to assembly thereof.

Referring now to FIG. 3(*a*), in which chain-dot lines indicate folding lines, the base portion 1 and column walls 2*a* . . . . . 9*b* are integrally connected parts of a single sheet of paperboard, of which the base portion 1 constitutes the central portion. The column walls 7*a*, 8*a* and 9*a* and 7*b*, 8*b* and 9*b* are all equal in width to the base portion 1 and constitute successive extensions from opposite short sides thereof. The walls 2*a* and 2*b* are somewhat longer than the base portion 1 and constitute integral extensions on opposite long sides thereof, and the walls 3*a* and 4*a* and 3*b* and 4*b* are equal in length to the base portion 1 and constitute successive integral extensions from the walls 2*a* and 2*b* respectively. In a generally central portion of the outer edge of the walls 9*a* and 9*b* respectively there are formed large integral flaps 10 and 11, which, upon assembly of the packaging means PM, may be engaged in slots 14 and 15, respectively, which are formed in central portions along the edges of the base portion 1 short sides. Symmetrically disposed on the outer edge of wall 4*a* are small integral flaps 5*a* and 5*b* which may respectively fit into symmetrically disposed slots 12*a* and 12*b* formed on the line of one long side of the base portion 1. Similarly, flaps 6*a* and 6*b* extending from the outer edge of the wall 4*b* may fit respectively into slots 13*a* and 13*b* formed on the line of the opposite long side of the base portion 1.

Figure 4:
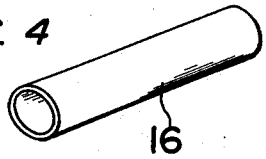
FIG. 4 is a perspective view of a re-inforcement pipe employed in the means of the invention.

Independent paper pipes 16, 17, 18 and 19 illustrated in FIG. 4 are associated with the sets of walls 2*a* through 4*a*, 2*b* through 4*b*, 7*a* through 9*a*, and 7*b* through 9*b* respectively. The paper pipes 16 and 17 have a length generally equal to that of one of the walls 3*a*, 3*b*, 4*a*, 4*b* and an external diameter generally equal to the width of one of the walls 3*a*, 3*b*, 4*a*, 4*b* minus the thickness thereof. The dimensions of the pipes 18 and 19 are similarly related to those of walls 7*a*, 7*b*, 8*a*, 8*b*, 9*a*, 9*b*.

Referring back to FIG. 3(*a*) and also to FIG. 2, to assemble the packaging means the paper pipe 18 is laid on wall 7*a*, the wall 9*a* is folded at right-angles to the wall 8*a*, the wall 8*a* is folded at right-angles to the wall 7*a*, the wall 7*a* is folded at right-angles to the base portion 1, and the flap 10 is inserted through slot 14, then folded back and affixed to the rear side of the base portion 1 by adhesive or similar means, walls 7*a* through 9*a* thus constituting the column 24 which contains the paper pipe 18 fitted therein without play and which at this stage is open at both ends but is subsequently sealed by end portions of walls 2*a* and 2*b* which are folded at right-angles to the base portion 1. The paper pipe 19 is similarly laid on wall 7*b*, and the paper pipes 16 and 17 on central portions of walls 2*a* and 2*b* respectively, and the sets of walls 7*b* through 9*b*, 2*a* through 4*a*, and 2*b* through 4*b* are similarly folded and the flaps 11, 5*a*, 5*b*, 6*a* and 6*b* are inserted through the slots 15, 12*a*, 12*b*, 13*a* and 13*b*, respectively, and folded and affixed to the rear of the base portion 1, thereby to constitute columns 25, 22 and 23 holding paper pipes 19, 16 and 17, respectively. In this assembled condition the ends of columns 24 and 25 are sealed by opposite end portions of walls 2*a* and 2*b*, and the ends of columns 22 and 23 by opposite end portions of walls 9*a* and 9*b*. If required, the outer joints of the columns 22 through 25 may be further secured by strips of adhesive material, as indicated by the shaded portions of FIG. 2.

In FIG. 3(*b*), after the abovedescribed assembly, auxiliary boards 20 and 21 are respectively constituted by columns of paper boards each having a square or near square cross-section and paper pipes 26 accommodated within the columns in the similar manner as described hereinbefore in the formation of the column 24 and paper pipe 16, and affixed to the rear of the base portion 1.

A pair of packaging means PM thus assembled is fitted around an article A to be packaged; the dimensions of the packaging means are easily altered in accordance with article dimensions. After the article A and packaging means PM are fitted together they may be treated as an independent unit by strapping the packaging means PM in place, or the article A and packaging means PM may be simply inserted into a container C, as illustrated in FIG. 1. In this packed condition, the article 26 is protected from impact by the re-inforced columns 22 through 25 and the auxiliary boards 20 and 21, and no supplementary packing operations are necessary. The auxiliary boards 20 and 21 also serve to facilitate packing and unpacking procedure, since they cause the packaging means PM to stand clear of the walls of the container C and thus permit hand or finger insertion to grip the packaging means PM and article A held therebetween. The paper pipes 16 through 19 may be any commercially available paper board pipes, and after unpacking of an article A the packaging means PM may be re-used, or may be easily disposed of as uniform material.

Figure 5:
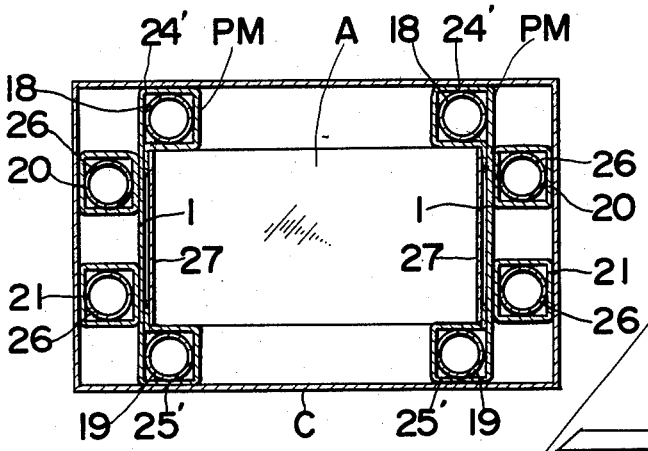
FIG. 5 is a horizontal cross-sectionl view illustrating packaging of an article with a means according to a 2nd embodiment of the invention.
Figure 6:
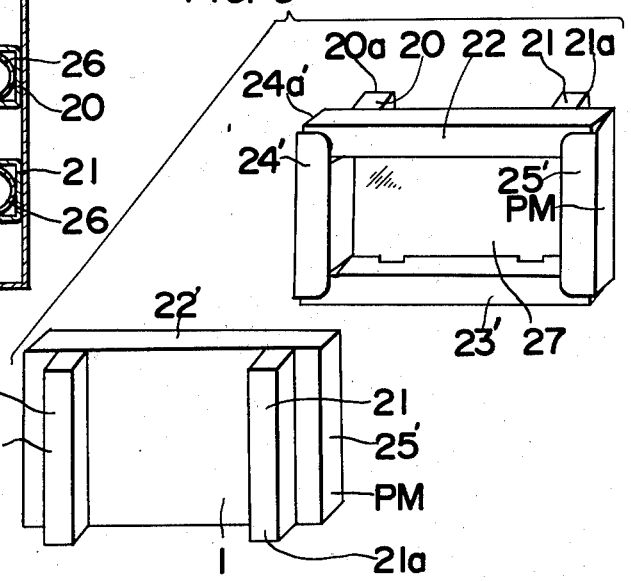
FIG. 6 is a perspective front view of the packaging means of FIG. 5.
Figure 7:
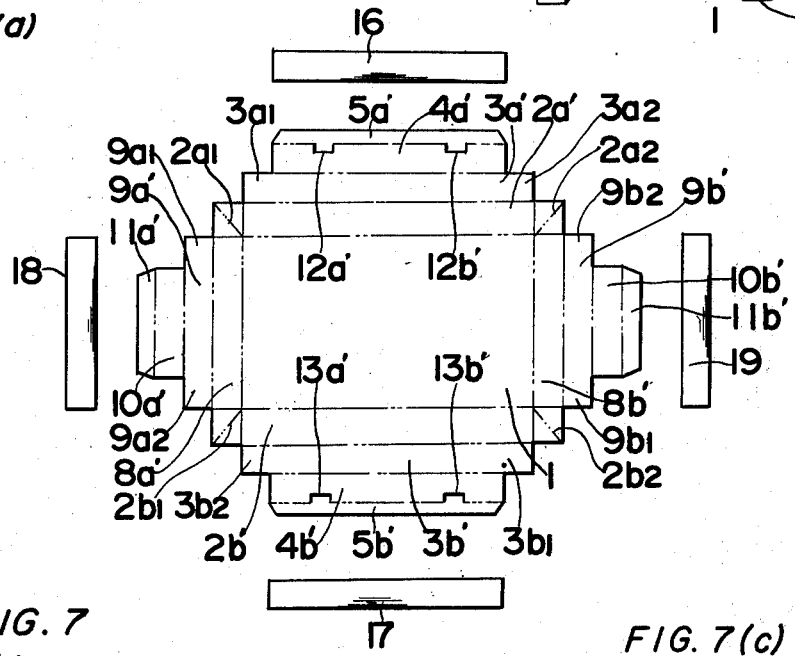
FIG. 7(*a*) is a plane view showing material of the means of FIG. 5 prior to assembly thereof.
Figure 7:
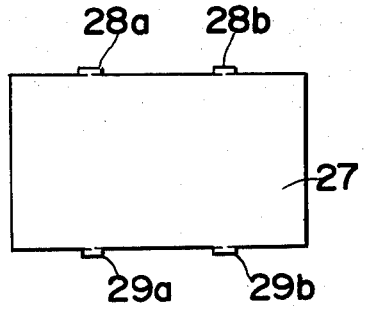
Figure 7C:
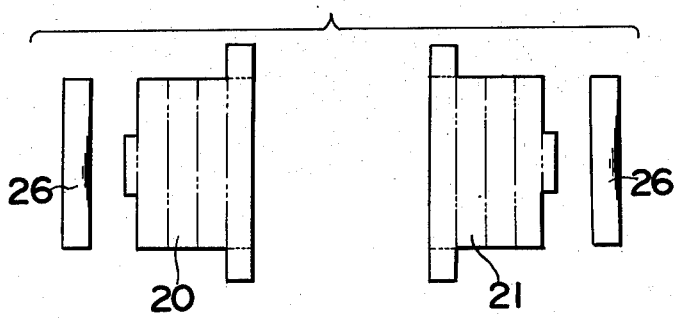

Reference is now had to FIGS. 5 through 7 which show a 2nd embodiment of the invention.

In FIG. 5 according to this embodiment an article A held in the packaging means PM does not contact the base portion 1 but contacts a supplementary base board 27 fitted over the inner side of the base portion 1 in a manner described below.

Referring to FIG. 6, in the assembled condition the packaging means PM has the general form of an open-topped box constituted by base portion 1 and supplementary base board 27 surrounding by columns 22' through 25' respectively constituted by sets of walls 2*a'* through 4*a'*, 2*b'* through 4*b'*, 8*a'* through 10*a'*, and 8*b'* through 10*b'*, and containing re-inforcement pipes 16' through 19' which have dimensions determined in a manner analogous to that employed in the first embodiment to permit fitting thereof without play in the columns 22' through 25'. Optionally the base portion 1 may be backed by auxiliary boards 20' and 21'.

In FIG. 7(*a*), the sets of walls 2*a'* through 4*a'* and 2*b'* through 4*b'* are successively smaller integral extensions from opposite the long sides of the base portion 1, and the sets of walls 8*a'* through 10*a'* and 8*b'* through 10*b'* are successively smaller integral extensions from opposite the short sides thereof. The outer edges of the walls 4*a'*, 4*b'*, 10*a'*, and 10*b'* are bordered by large integrally attached flaps 5*a'*, 5*b'*, 11*a'*, and 11*b'* respectively. The wall 2*a'* has opposite end corner portions 2*a*1 and 2*a*2 in common with the end corner portions of the walls 8*a'* and 8*b'*, and the wall 2*b'* has end corner portions 2*b*1 and 2*b*2 in common with the other end corner portions of the walls 8*a'* and 8*b'*. Each of these common end portions 2*a*1 through 2*b*2 is approximately square and is folded diagonally during assembly of the packaging means to form two triangular portions. In the wall 4*a'* there are formed symmetrically disposed slots 12*a'* and 12*b'*, which serve to permit mounting of the supplementary base board 27, and which are adjacent to the junction of the wall 4*a'* and flap 5*a'*. Slots 13*a'* and 13*b'* are similarly disposed in the wall 4*b'*.

In FIG. 7(*b*), the supplementary base board 27 is constituted by a sheet of paperboard comprising a main portion having dimensions generally equal to those of base portion 1 and having on each long side thereof a pair of integrally attached flaps 28*a* and 28*b*, or 29*a* and 29*b*, which may fit into the slots 12*a'* and 12*b'*, or 13*a'* and 13*b'* in the walls 4*a'* and 4*b'*.

Still referring to FIG. 7, and also referring to FIG. 6, to assemble the packaging means PM, the common end corner portions 2*a*1 through 2*b*2 are folded inwards, the walls in each of the sets of walls are folded at right-angles to one another, as before, to constitute columns for containment of re-inforcement pipes, and the flaps 5*a'*, 5*b'*, 11*a'* and 11*b'* are bent at right-angles to the walls 4*a'*, 4*b'*, 10*a'* and 10*b'* respectively and are attached to the inner surface of the base portion 1. The common end corner portions 2*a*1 through 2*b*2 may be affixed in their folded condition to the insides of walls 2*a* and 2*b* or walls 8*a* and 8*b*. In this assembled condition opposite end portions 9*a*1 and 9*a*2 of wall 9*a'* overlap end portions 3*a*1 and 3*b*2, and opposite end portions 9*b*1 and 9*b*2 of the wall 9*b*1 overlap end portions 3*b*1 and 3*a*2 of walls 3*b'* and 3*a'*. Also, the slots 12*a'* through 13*b'* lie level with, or near the level of, the inner side of the base portion 1, and permit the supplementary base board 27 to be mounted over the base portion 1 to provide extra protection to packaged articles. The supplementary base board flaps 28*a*, 28*b*, 29*a* and 29*b* are inserted into the slots 12*a'*, 12*b'*, 13*a'* and 13*b'*, to affix the flaps 5*a'*, 5*b'*, 10*a'* and 10*b'* to the inner surface of the base portion 1 and are further affixed by adhesive if required.

Figure 8:
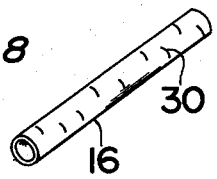
FIGS. 8 and 9 are perspective views of modifications of the re-inforcement pipe of FIG. 4.

Referring now to FIG. 8, there is shown a modification of the paper pipes employed in the means of the invention. These pipes have formed therein a plurality of small slots 30 extending through the outer periphery thereof, whereby the pipes, while still providing shock-proof structural strength to a packaging means PM, are flexible and present a certain spring effect.

Figure 9:
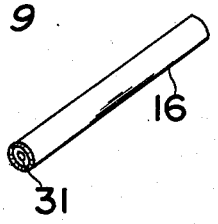
Figure 3:
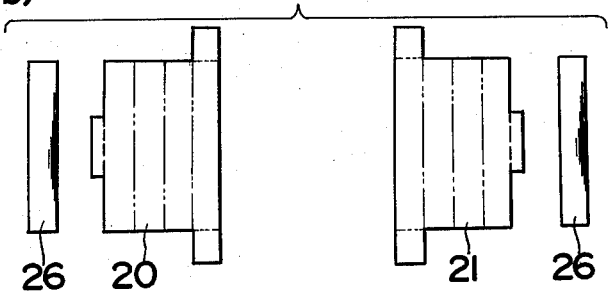
Figure 10:
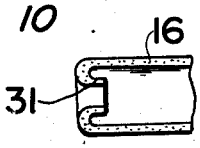
FIG. 10 is a detail view of a terminal portion of the modified re-inforcement pipe shown in FIG. 9.

FIGS. 9 and 10 show another modification of the paper pipe construction according to which the opposite ends of a pipe form extensions 31 which are folded inwardly with respect to the pipe. This modification is suitable when greater rigidity and strength of packaging means are required.

As is clear from the above description, the present invention provides a shock-proof packaging means which is cheaply and easily assembled, or disposed of, and permits a straightforward packing procedure.

What is claimed is:

1. Packaging means adapted to be inserted into a box-like container along with an item being packaged in said container for insulating and bracing said item from shock and impact and for preventing the item from breaking, said packaging means comprising in combination with an item to be packed and a packing container:

at least one pair of first bracing means fitted to the ends of said item being packed and adapted to be inserted into said container for bracing said item from the sides of said container, each individual member of said pair of bracing means being comprised of:

a single sheet of cardboard forming a first base portion having a plurality of sides and first and second surfaces, said second surface being opposite said first surface, a plurality of wall members integrally attached to the plurality of sides of said first base portion and folded into a plurality of first, hollow, square cross-sectioned columns surrounding said first surface of said base portion, at least two of said first, hollow, square cross-sectioned columns on opposite sides of said first base portion having spaced engagement slits therein adjacent said first surface of said first base portion, a supplementary base portion similar in shape to said first base portion surrounded by said first, hollow, square cross-sectioned columns and having a plurality of extensions integrally formed thereon on at least two opposite sides and spaced corresponding to the slits in said first, hollow, square cross-sectioned columns, said supplementary base portion being positioned next to said first surface of said first base portion with said extensions thereof engaged in said slits of said first, hollow, square cross-sectioned columns, whereby a multi-sided bracing recess with said first, hollow, square cross-sectioned columns as sides and said first base portion as a base is reinforced by said supplementary base portion engaged in said slits of said first, hollow, square cross-sectioned columns next to said first surface of said first base portion, and a plurality of hollow cylindrical tubes having an outer diameter substantially equal to the internal distance between the walls of said first, hollow, square cross-sectioned columns, one of said tubes being fitted into each of said first, hollow, square cross-sectioned columns, for increasing the strength of said columns; and second bracing means secured to each of said first bracing means on said second surface thereof for bracing and spacing said first bracing means and the item held therein from the ends of said container, said second bracing means comprised of:

at least two sheets of cardboard folded into second substantially square cross-sectioned hollow columns and attached to the second surface of each first base portion, and a plurality of second cylindrical tubes having an outer diameter substantially equal to the internal distance between the walls of said second substantially square cross-sectioned hollow columns, one cylindrical tube being fitted into each of said second columns.

2. Packing means as claimed in claim 1 wherein each of said cylindrical tubes has a plurality of circumferential slots therethrough in a spaced relationship to each other.

3. Packing means as claimed in claim 1 wherein said cylindrical tubes have at each end a portion thereof inwardly turned and extended into the hollow portion of the tube.

* * * * *